United States Patent [19]

Kiper

[11] Patent Number: 4,856,445

[45] Date of Patent: Aug. 15, 1989

[54] SAILBOAT CONSTRUCTION

[76] Inventor: James B. Kiper, 17A Boston St., Coventry, R.I. 02816

[21] Appl. No.: 158,281

[22] Filed: Feb. 18, 1988

[51] Int. Cl.[4] ..... B63B 1/00; B63B 9/00

[52] U.S. Cl. ..... 114/39.1; 114/61; 114/129

[58] Field of Search ..... 114/39.1, 129, 61

[56] References Cited

U.S. PATENT DOCUMENTS

| | | | |
|---|---|---|---|
| 3,802,366 | 4/1974 | Mankawich | 114/61 X |
| 3,844,238 | 10/1974 | Murray | 114/39.1 |
| 4,164,909 | 8/1979 | Ballard | 114/39.1 X |
| 4,314,518 | 2/1982 | Marsden | 114/39.1 |

FOREIGN PATENT DOCUMENTS

| | | | |
|---|---|---|---|
| 1357732 | 6/1974 | United Kingdom | 114/39.1 |

*Primary Examiner*—Sherman D. Basinger
*Attorney, Agent, or Firm*—Salter & Michaelson

[57] ABSTRACT

A sailboat construction includes a hull having spaced first, second and third longitudinally extending lateral resistance elements which provide resistance to lateral movement of the boat under normal sailing conditions. The first and third resistance elements are spaced outwardly from opposite sides of the centerline of the hull in the forward portion thereof, and the second resistance element is aligned with the centerline in the aft portion of the hull. Because of the positions of the resistance elements, the boat is increasingly automatically turned into the wind as it is increasingly heeled over by the force of the wind, and as a result, the wind is normally spilled from the sails to return the boat to a more upright disposition before a capsizing situation can occur.

8 Claims, 3 Drawing Sheets

SAILBOAT CONSTRUCTION

BACKGROUND AND SUMMARY OF THE INVENTION

The instant invention relates to sailboats and more particularly to a sailboat which is adapted so that it is virtually uncapsizable due to wind effects under most conditions.

While the sport of sailing has gained significant popularity in recent years, it has been found that many sailboats, particularly those under 20 feet in length, are relatively prone to capsizing due to the force of the wind, even when they are sailed under relatively light wind conditions. It has been further found that although it can often be a relatively simple matter to right a relatively small single-hull sailboat after it has capsized, it can be extremely difficult to right a multihull vessel, such as a catamaran, or a trimaran. In any case, heretofore the possibility of capsizing has represented a significant threat to many sailboaters, and it has discouraged many persons from participating in the sport of sailing.

The instant invention provides a sailboat construction which is adapted so that it is virtually uncapsizable due to wind effects under most wind and sea conditions, and which can therefore be operated with an increased level of safety by even relatively inexperienced sailors. More specifically, the instant invention provides a sailboat construction which is adapted so that it automatically turns into the wind whenever it is exposed to a potential capsizing situation. Still more specifically, the sailboat construction of the instant invention is adapted so that the hull and sails thereof cooperate to produce a turning moment which increasingly causes the boat to be turned into the wind as it is increasingly heeled over by the force of the wind. In other words, the sailboat of the subject invention is adapted so that it is automatically turned into the wind to spill the wind from the sails thereof and to return the boat to an more upright disposition before it can reach the point of capsizing. The sailboat construction of the instant invention comprises a hull, a spar assembly on the hull and at least one sail which is supported by the spar assembly so that it is operative in response to wind movement for propelling the boat in a forward direction. The hull is constructed so that it includes first, second and third lateral resistance elements which extend into the water for resisting lateral movement of the hull when the latter is in a substantially level horizontal disposition. The first and third lateral resistance elements are positioned on the hull so that they are spaced outwardly from opposite sides of the longitudinal centerline or axis of the hull, and they are further constructed so that the theoretical centers of lateral resistance thereof are located forward of the theoretical center of the sail area of the boat when the sails are in substantially perpendicular relation to the longitudinal centerline of the hull. The second resistance element is positioned so that it is substantially aligned with the longitudinal centerline of the hull and so that the theoretical center of lateral resistance thereof is located aft of the theoretical center of the sail area of the boat when the sails are substantially aligned with the longitudinal centerline of the hull. In this connection, the theoretical centers of lateral resistance of the first, second and third hull sections represent the theoretical points thereof through which lateral force vectors representing the lateral resistances applied by the first, second and third resistance elements, respectively, extend during a normal sailing operation. The theoretical center of the sail area of a boat having a single sail is defined as the geometrical center of the sail, and the theoretical center of the sail area of a boat having a pair of sails is defined as that point in space which is located along a line between the centers of the two sails in proportion to the areas of the two sails. Similarly, the theoretical center of the sail area of a boat having more than two sails is defined by a geometrical weighted average of the center of the sails thereof. The sailboat of the subject invention preferably comprises both a mailsail and a jib, and hence, absent additional sails, the theoretical center of the sail area at any given time is located along a line which extends between the geometrical center of the mainsail and the geometrical center of the jib in proportion to the areas of the mainsail and the jib. The sailboat preferably comprises a tri-hull-type hull which includes laterally spaced first, second and third longitudinally extending hull sections, and the first, second and third hull sections are preferably integrally connected and include the first, second and third lateral resistance elements, respectively. In a first embodiment of the sailboat construction, the first, second and third resistance elements are preferably integrally formed with the first, second and third hull sections, and they are formed so that they define the main areas of buoyancy in the hull. In a second embodiment of the sailboat construction, the resistance elements comprise board-like members which are substantially aligned with the longitudinal centerline of the hull. In this embodiment the first and third resistance elements are preferably formed so that they are disposed substantially entirely forward of the theoretical center of the sail area of the boat when the sails are substantially perpendicular to the longitudinal centerline of the hull, and the second resistance element is preferably formed so that it is disposed substantially entirely aft of the theoretical center of the sail area of the boat when the sails are substantially aligned with the longitudinal centerline of the hull.

It has been found that the sailboat of the instant invention can be effectively sailed by even inexperienced sailors without significant risk of capsizing. In this connection, the tri-hull configuration of the sailboat of the subject invention makes it inherently stable under most conditions. However, because of the manner in which the hull is constructed, and in particular the positions of the lateral resistance elements, it is effectively impossible to capsize the sailboat of the subject invention, under most wind conditions. Specifically, the hull is constructed so that as the boat is increasingly heeled over due to the force of the wind, it automatically increasingly turns into the wind to spill the wind from the sails thereof and return the boat to a more upright condition before a capsizing situation can occur. More specifically, when the force of the wind causes either the first resistance element or the third resistance element to be lifted out of the water and the second resistance element to be partially lifted out of the water, the force of the wind cooperates with the resistance element remaining in the water to produce a turning moment which inherently turns the boat into the wind. As a result, before the boat can be heeled over the point of capsizing, it inherently turns into the wind to spill the wind from the sails thereof in order to return the boat to a more upright disposition.

Sailboats representing the closest prior art to the subject invention of which the applicant is aware are disclosed in the U.S. Pat. Nos. 3,910,214; to Holter, 3,922,994; De Long, 3,937,166; Lindsay, 3,949,695; Pless, 3,974,535; Guanzini, 3,996,869; Hadley, 3,998,175; Pless, 4,004,534; Allison, 4,159,691; Paxton, 4,172,426; Susman, 4,224,889; Spiegel, 4,286,534; Sanner, 4,287,845; Sanner, 4,392,444; Andersson, and 4,582,011 Logan. However, since these references fail to suggest the concept of constructing a sailboat hull so that it includes resistance elements which are operative in cooperation with the sails thereof for producing a turning moment which steers the boat into the wind in the manner of the sailboat of the subject invention, they are believed to be of only general interest.

Accordingly, it is a primary object of the instant invention to provide a sailboat construction which is virtually uncapsizable under most wind and sea conditions.

Another object of the instant invention is to provide a sailboat construction which can be operated with an increased level of safety.

An even further object of the instant invention is to provide a tri-hulled sailboat construction which is increasingly automatically turned into the wind as it is increasingly heeled over due to the force of the wind.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 2:
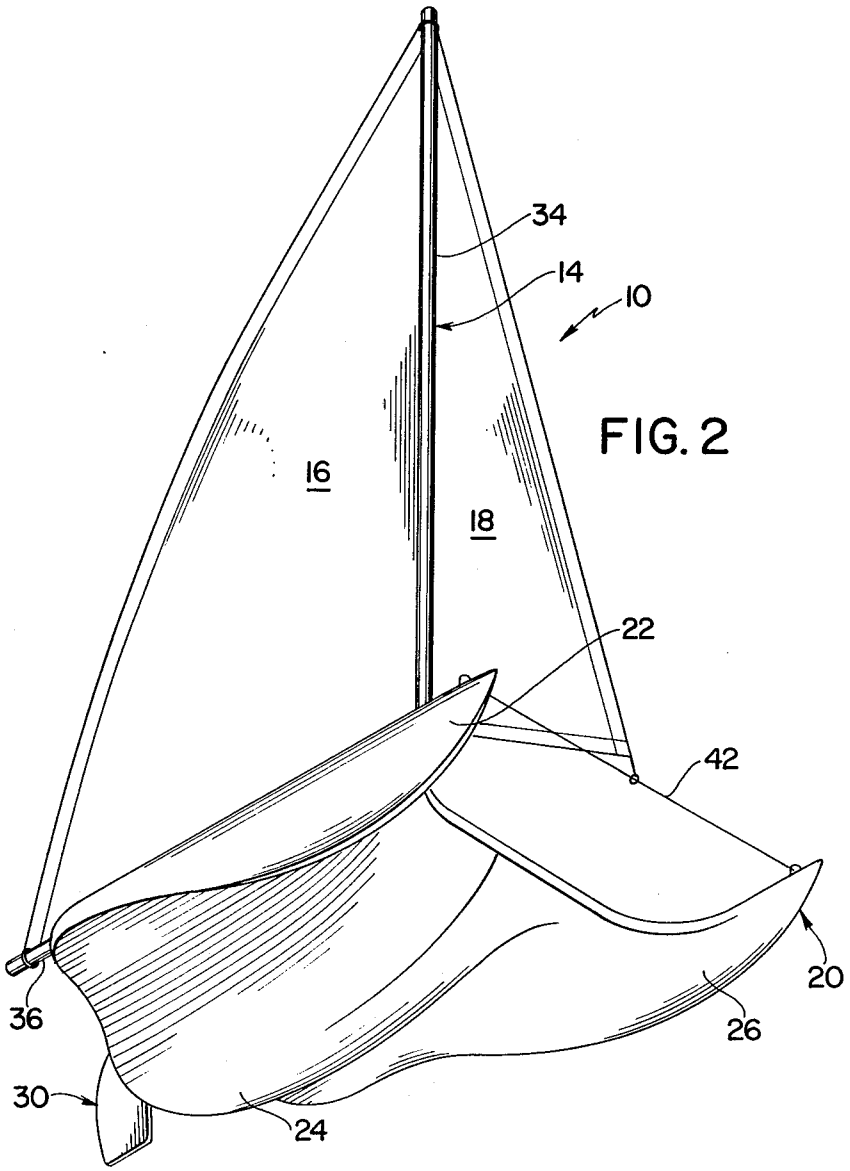
FIG. 2 is a bottom perspective view thereof.
Figure 1:
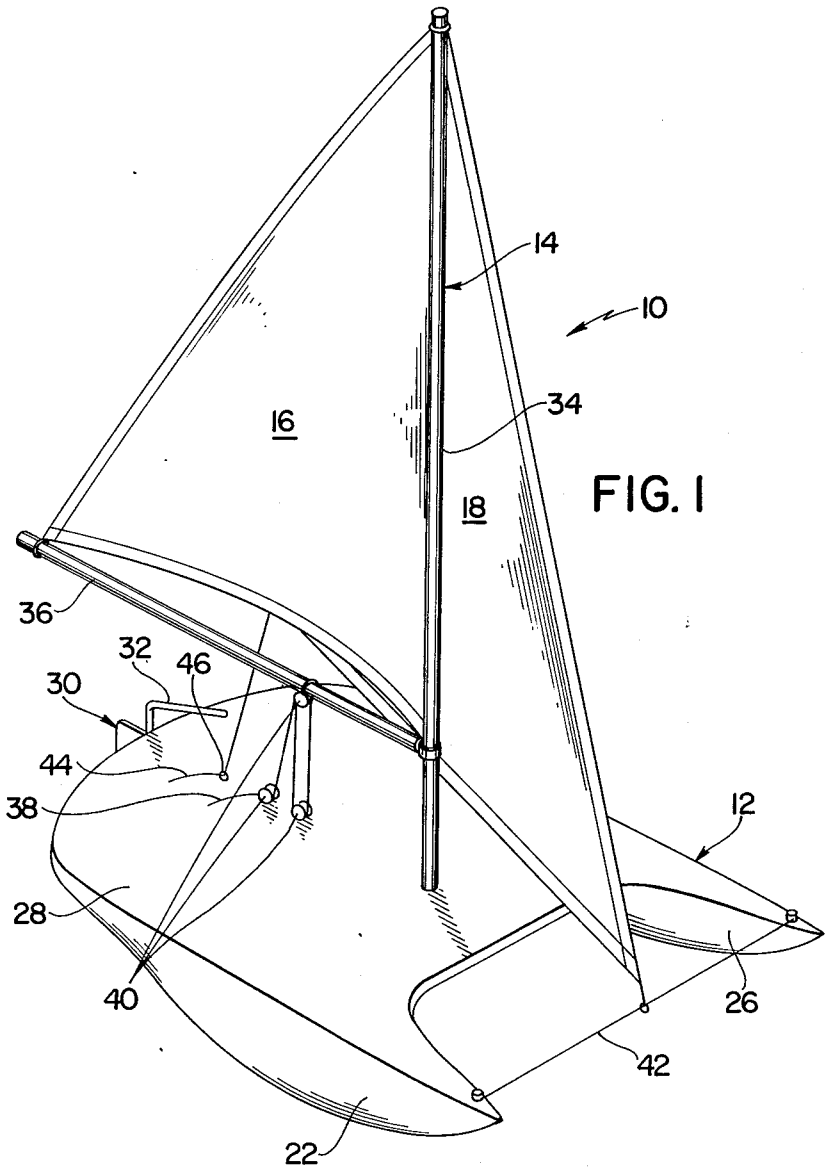
FIG. 1 is a perspective view of a first embodiment of the sailboat of the instant invention.
Figure 6:
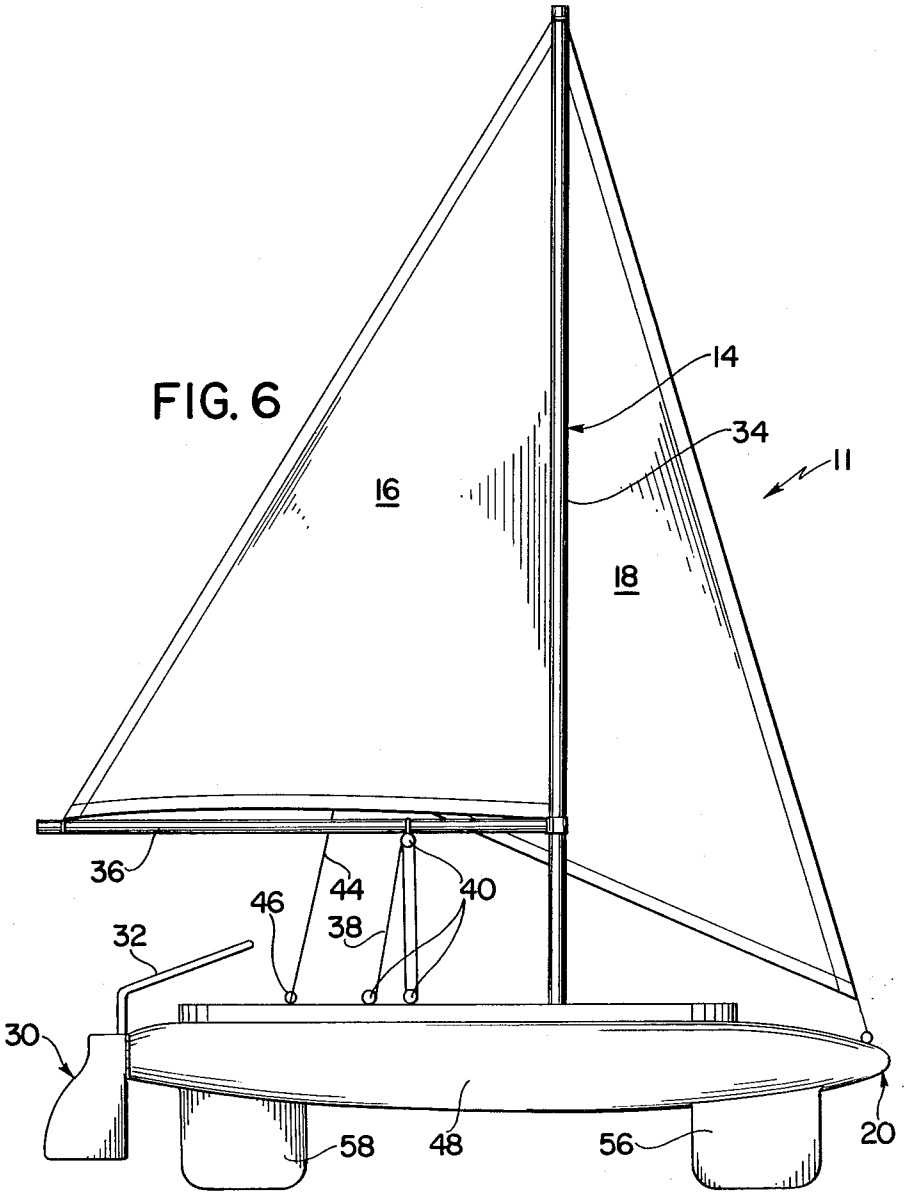
FIG. 6 is a side elevational view thereof.
Figure 3:
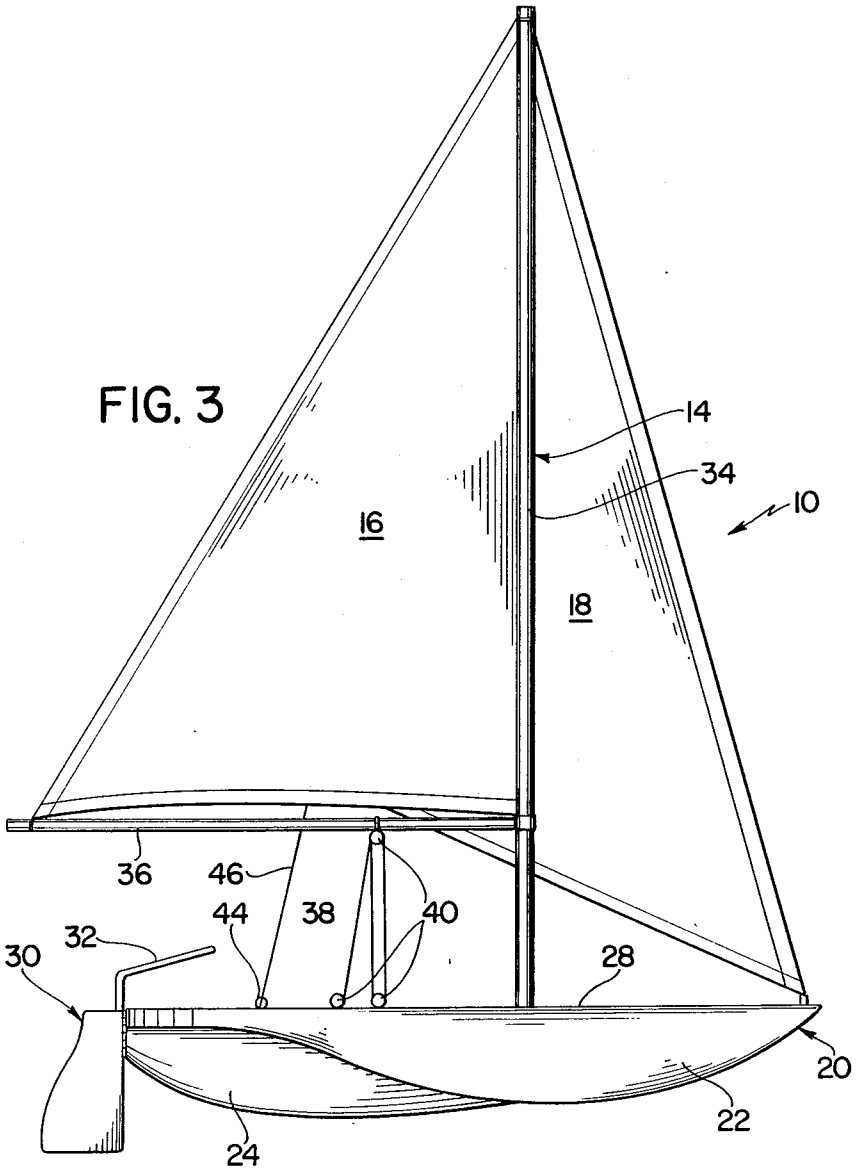
FIG. 3 is a side elevational view thereof.
Figure 5:
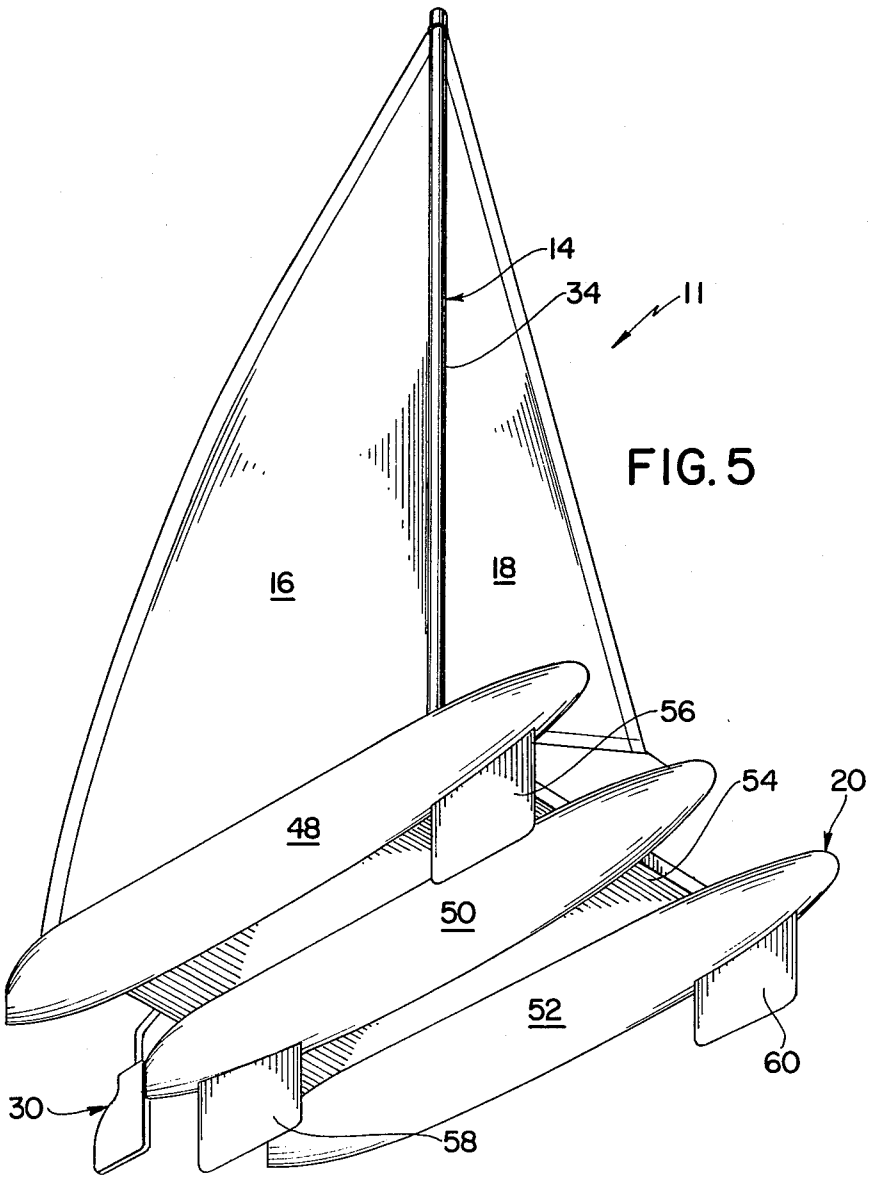
FIG. 5 is a bottom perspective view thereof.
Figure 4:
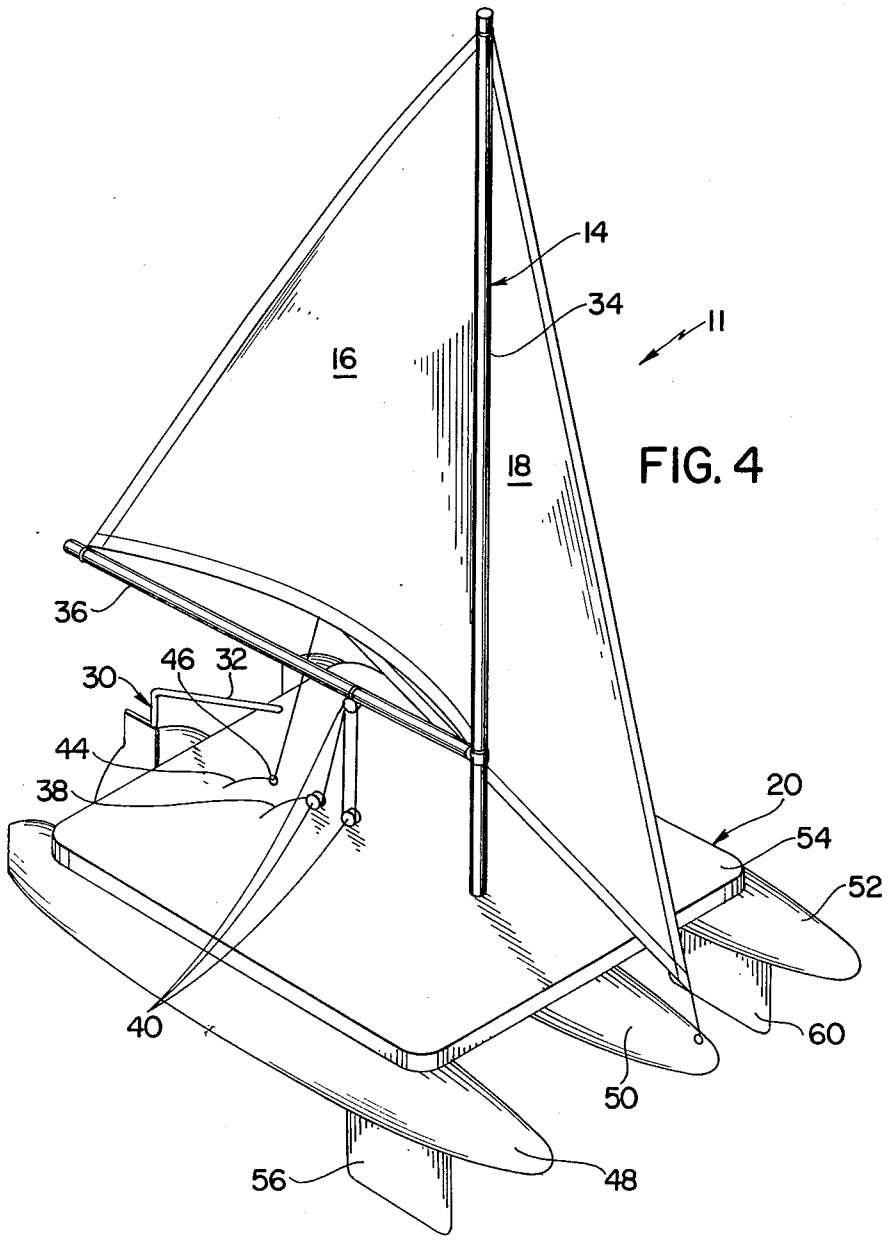
FIG. 4 is a perspective view of a second embodiment of the sailboat.

Referring now to the drawings, a first embodiment of the sailboat of the instant invention is illustrated in FIGS. 1–3 and generally indicated at 10, and a second embodiment of the sailboat of the instant invention is illustrated in FIGS. 4–6 and generally indicated at 11. The sailboat 10 comprises a hull generally indicated at 12, a spar assembly generally indicated at 14, a mainsail 16, and a jib 18. The sailboat 11, on the other hand, comprises a hull assembly 20, and a spar assembly 14, a mainsail 16 and a jib 18. Both the boat 10 and the boat 12 are, however, adapted so that when they heel over while sailing under heavy wind conditions, they are automatically turned into the wind so that the wind is spilled from the sails thereof before a capsizing situation can occur.

Referring first to FIGS. 1–3 and the boat 10, the hull 12 is preferably made from a suitable material, such as fiberglass, and it is formed in a tri-hull configuration so that it includes first, second and third laterally spaced, integrally formed, longitudinally extending hull sections 22, 24 and 26, respectively. The first, second and third hull sections 22, 24 and 26, respectively, are preferably hydrodynamically designed, and they define the main areas of buoyancy in the hull 12, and they are also formed so that they normally project downwardly into the water in order to provide resistance to lateral movement of the hull 12 when the hull 12 is in a substantially level disposition. The second hull section 24 is formed in an elongated rounded configuration, and it is substantially aligned with the longitudinal centerline of the hull 12, although it is located predominantly in the aft portion of the hull 12. The first and third hull sections 22 and 26, respectively, are formed in generally elongated, narrow configurations, they are spaced outwardly on opposite sides of the longitudinal centerline of the hull 12, and they are predominantly located in the forward portion of the hull 12 as illustrated most clearly in FIG. 2. The hull 12 is preferably further formed so that it includes a substantially flat supporting platform 28, and a conventional rudder assembly 30 is attached to the aft portion of the hull 12 so that it projects downwardly beyond the second hull section 24 for steering the boat 10, the rudder assembly 30 being attached to the hull 12 along the longitudinal centerline thereof and including a conventional tiller 32.

The spar assembly 14 includes a mast 34 and a boom 36 which are preferably made from anodized aluminum or some other suitable rigid material. The mast 34 is received in a socket in the hull 12 for supporting it in a substantially upright disposition, and the boom 36 is pivotably attached to the mast 34 in a conventional manner. The mainsail 16 is attached to the mast 34 and to the boom 36, and a mainsheet 38 which is attached to the boom 36 extends through a series of pulleys 40, two of which are attached to the support platform 28 to enable the mainsheet 38 to be effectively utilized for controlling the position of the boom 36 and the mainsail 16 relative to the hull 12. The jib 18 is attached to the mast 34 and to a cable 42 which extends between the forward extremities of the first and third hull sections 22 and 26, respectively. A jibsheet 44 which is attached to the jib 18 extends through a pulley 46 for controlling the position of the jib 18 in a conventional manner.

The boat 10 is specifically constructed so that when it is heeled over due to the force of the wind, it is automatically steered into the wind in order to spill the wind from the sails 16 and 18 thereof and return the boat 10 to a more normal or level disposition before a capsizing situation can arise. In order to effect this purpose, the first, second and third hull sections 22, 24 and 26, respectively, are constructed and oriented with respect to the sails 16 and 18 so that the sails 16 and 18 and the spar assembly 14 cooperate therewith to produce a turning moment which causes the boat 10 to be turned into the wind under certain conditions. More specifically, the first and third hull sections 22 and 26, respectively, are constructed and positioned so that the theoretical centers of lateral resistance thereof are located forward of the theoretical center of the sail area of the sails 16 and 18 when the sails 16 and 18 are in substantially perpendicular relation to the longitudinal center line of the hull 10, and the second hull section 24 is constructed and oriented so that the theoretical center of lateral resistance thereof is located aft of the theoretical center of the sail area of the sails 16 and 18 when the sails 16 and 18 are substantially aligned with the longitudinal centerline of the hull 12. In this connection, the theoretical centers of lateral resistance of the first, second and third hull sections 22, 24 and 26 respectively, are defined as the points through which corresponding lateral force vectors representing the lateral forces applied by the first, second and third hull sections 22; 24 and 26 would extend during a normal sailing operation. The theoretical center of the sail area of the boat 10 at any given time is defined by a point located on a line which extends between the geometrical center of the sail 16 and the geometrical center of the sail 18 in proportion to the areas of the two sails 16 and 18. For purposes of defining the relative positions of the various portions of the hull 12, the theoretical center of the sail area is considered to be the point where a vector representing the force of the wind is applied to the boat 10. In this connection, however, in actual fact the theoretical force vector representing the force of the wind applied to the boat 10 is applied at a theoretical point referred to as the "center of effort" which may differ slightly from the center of the sail area due to air-foil effects, etc., on the sails 16 and 18. However, as a practical matter, the center of the sail area represents a reasonable approximation of the "center of effort". Accordingly, the theoretical center of the sail area can be effectively utilized as a reference point for defining the locations of the theoretical centers of lateral resistance of the hull sections 22, 24, and 26.

During use and operation of the sailboat 10, the rudder assembly 30 is operated to steer the boat 10, and the mainsheet 38 and the jibsheet 44 are operated to position the jib 18 and the mainsail 16 at proper sailing angles relative to the hull 12 in order to propel the boat 10 in a forward direction. In this connection, when the boat 10 is sailed at an angle to the wind so that a significant lateral force is applied to the boat 10 by the wind, the first, second and third hull sections 22, 24 and 26, respectively, counteract the lateral force of the wind, and the boat 10 is propelled in a forward direction. However, when the force of the wind causes the boat 10 to heel over so that the windward hull section 22 or 26 and the center or second hull section 24 are at least partially raised out of the water, the remaining lateral forces on the boat 10 are due primarily to the effect of the wind and the effect of the leeward hull section 22 or 26 which remains fully in the water. Accordingly, since the force of the wind is effectively applied at the theoretical center of the sail area and since this point is located aft of the theoretical center of resistance of the leeward hull section 22 or 26, the wind and the leeward hull section 22 or 26 cooperate to produce a turning moment which causes the hull 12 to be turned into the wind. As a result, the wind is automatically spilled from the sails 16 and 18 before a capsizing situation can occur, and the boat 10 is automatically returned to a more level or upright disposition.

The sailboat 11 is illustrated in FIGS. 4–6 and it comprises the hull 20, a spar assembly 14, a mainsail 16, a jib 18, and a rudder assembly 30. The sailboat 11 further comprises a mainsheet 38 which extends through a series of pulleys 40 and a jibsheet 44 which extends through a pulley 46.

The hull 20 is also formed in a tri-hull configuration and it includes spaced first, second and third hull sections 48, 50 and 52, respectively, and a support platform 54 which is attached to the hull sections 48, 50 and 52 so that it is operative for maintaining them in spaced, substantially parallel relation. The second hull section 50 is positioned in substantially aligned relation with the longitudinal axis of the hull 20, and the first and third hull sections 48 and 52 are disposed in substantially parallel relation to the first hull section 50 and in outwardly spaced relation from opposite sides thereof. The first, second, and third hull sections 48, 50 and 52 are formed as elongated pontoon-like members which are operative for providing buoyancy in the hull 20, and first, second and third keel members 56, 58 and 60 project downwardly from the first, second and third hull sections 48, 50 and 52, respectively, for providing resistance to lateral movement of the hull 20, as illustrated most clearly in FIGS. 5 and 6. The first and third keel members 56 and 60 are positioned so that the effective centers of lateral resistance thereof are located forward of the theoretical center of the sail area of the sailboat 11 when the sails 16 and 18 are in substantially perpendicular relation to the centerline of the hull 20, and the second keel member 58 is positioned so that the theoretical center of lateral resistance thereof is located aft of the theoretical center of the sail area of the sailboat 11 when the sails 16 and 18 are substantially aligned with the centerline of the hull 20.

Accordingly, during use and operation of the sailboat 11, the keel members 56, 58 and 60 cooperate with the sails 16 and 18 to automatically turn the boat 11 into the wind so that the wind is spilled from the sails 16 and 18, and the boat 11 is returned to a more level or upright disposition before a capsizing situation can occur. More specifically, when the force of the wind causes the boat 11 to heel over so that the windward keel member 56 or 60 and the second keel member 58 are at least partially raised out of the water, the remaining or leeward keel member 56 or 60 cooperates with the force of the wind to turn the boat 11 into the wind so that the wind is spilled from the sails 16 and 18.

It is seen therefore that the instant invention provides an effective and safe sailboat construction which is adapted so that it automatically turns into the wind before a capsizing situation occurs. Accordingly, under normal conditions, the boats 10 and 11 can be sailed by even relatively inexperienced sailors without similar risk of capsizing. Accordingly, it is seen that the instant invention represents a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed:

1. A sailboat construction comprising a hull having a longitudinal center line, spar means on said hull, and sail means supported by said spar means, said sail means including at least one sail and being operative in response to wind movement for propelling said hull in a forward direction, said hull including first, second and third lateral resistance means, each of said lateral resistance means normally extending into the water and each being operative for substantially preventing lateral movement of said hull in both port and starboard direction, said first and third lateral resistance means being substantially parallel to said hull centerline and being spaced outwardly on opposite sides thereof, the theoretical center of lateral resistance of each of said first and third resistance means being disposed forward of the theoretical center of the sail area of said sail means when said sail means is substantially perpendicular to the longitudinal centerline of said hull, said second resistance means being substantially aligned with the longitudinal centerline of said hull, the theoretical center of resistance of said second resistance means being disposed aft of the theoretical center of the sail area of said sail means when said sail means is substantially aligned with the longitudinal centerline of said hull.

2. In the sailboat construction of claim 1, said sail means comprising a mainsail and a jib.

3. In the sailboat construction of claim 1, said hull further characterized as a tri-hull including spaced first, second and third hull sections which include said first, second and third resistance means, respectively.

4. In the sailboat construction of claim 3, said first, second and third hull sections being integrally connected, said first, second and third resistance means being integrally formed in said first, second and third hull sections, respectively.

5. In the sailboat construction of claim 4, said first, second and third resistance means defining the main areas of buoyancy in said hull.

6. In the sailboat construction of claim 3, said first, second and third resistance means comprising keel members which are substantially parallel to the longitudinal centerline of said hull.

7. In the sailboat construction of claim 1, said first and third resistance means being substantially entirely forward of the theoretical center of the sail area of said sail means when said sail means is substantially perpendicular to the longitudinal centerline of said hull.

8. In the sailboat construction of claim 7, said second resistance means being substantially entirely aft of the theoretical center of the sail area of said sail means when said sail means is substantially aligned with the longitudinal centerline of said hull.

* * * * *